US007070511B2

(12) United States Patent
Gustine

(10) Patent No.: US 7,070,511 B2
(45) Date of Patent: Jul. 4, 2006

(54) INDEXING GOLF MAT FOR A GOLF DRIVING RANGE

(76) Inventor: Floyd L. Gustine, 5631 Curry Rd., Pittsburgh, PA (US) 15236

( * ) Notice: Subject to any disclaimer, the term of this patent is extended or adjusted under 35 U.S.C. 154(b) by 72 days.

(21) Appl. No.: 10/401,186

(22) Filed: Mar. 27, 2003

(65) Prior Publication Data

US 2004/0192459 A1 Sep. 30, 2004

(51) Int. Cl.
*A63B 67/00* (2006.01)

(52) U.S. Cl. ..... 473/278; 473/163; 473/279

(58) Field of Classification Search ..... 473/278, 473/279, 160, 161, 157, 168, 171; 428/17
See application file for complete search history.

(56) References Cited

U.S. PATENT DOCUMENTS 1,779,995 A * 10/1930 Trane ..... 473/398
1,810,906 A * 6/1931 Carter ..... 473/396
2,515,847 A * 7/1950 Winkler ..... 428/17
4,497,853 A * 2/1985 Tomarin ..... 428/17
5,046,741 A * 9/1991 Ahn ..... 473/279
5,156,398 A * 10/1992 Kibamoto ..... 473/278
5,248,144 A * 9/1993 Ullerich ..... 473/279
5,558,334 A * 9/1996 Roche ..... 473/279
5,645,494 A * 7/1997 Dionne et al. ..... 473/278
5,916,034 A * 6/1999 Lancia ..... 473/157
6,050,902 A * 4/2000 McCrink Jr. ..... 473/168
6,106,409 A * 8/2000 Jackson, Jr. ..... 473/278
6,171,201 B1 * 1/2001 Tiller ..... 473/278

* cited by examiner

*Primary Examiner*—Nini F. Legesse
(74) *Attorney, Agent, or Firm*—Clifford A. Poff

(57) ABSTRACT

A golf practice mat is formed by a circular or rectangular golf mat with a sufficiently large playing surface to support a golfer for address of a golf ball on a tee located in a contiguous outer peripheral margin of the playing surface. The spaced apart golf ball hitting areas each include the golf club approach path and a golf club follow through path intercepted by the golf tee mounting aperture. The golf mat is rotated about an axle within spandrels or filler pieces supported on a platform about the outer periphery of the golf mat.

10 Claims, 5 Drawing Sheets

INDEXING GOLF MAT FOR A GOLF DRIVING RANGE

CROSS-REFERENCE TO RELATED APPLICATIONS

Not applicable

BACKGROUND OF THE INVENTION

1. Field of the Invention

The present invention relates to providing a succession of renewable golf ball hitting areas including a golf ball approach path and a golf club follow through path at opposite sides of a golf tee in a golf mat for a golf driving range and, more particularly, to a golf mat rotatably within stationary extensions on an underlying platform.

2. Description of the Prior Art

As is well known in the art, it is a common practice to use a tee, usually made of wood, to support a golf ball above a playing field so that a golf club can be impacted with a golf ball. This mode of driving a golf ball is practiced at a teeing area as well as at a driving range, for example. The extent of adjustment to the height of the golf ball above the playing field is limited by the height of the tee and the soil conditions, which govern the length of the shank of the tee extending beneath the golf ball support surface, which must penetrate the earth to obtain a stable support. A golf ball tee of this type is inexpensive and constructed so that it can be lost without usually any desire to recover the tee in the event the tee is dislodged from the playing surface upon impact with the golf club. At a driving range where golfers practice driving golf balls for distance and accuracy, the golf ball is usually supported by a permanent structure generally level either with the playing field or at a fixed height above it. The golfer cannot vary the height at which the golf ball is supported above the playing field. It is desirable to practice driving techniques to simulate driving golf balls both from the tee box where the golf ball is usually located above the playing field as well as from a fairway and of course sometimes, in the taller grass in the rough where a golf ball tee should not be used and thus the golf ball must be hit while supported by the playing field.

In the course of practice golf ball driving swings, the artificial turf surrounding the golf ball tee at a driving range undergoes wear and tear due to contact between the turf and the golf club and contact between the golf ball and the turf. The area subject to such wear and tear is predominately limited to a golf ball hitting area made up of a golf club approach path and a golf club follow through path, which is intercepted by a golf tee. The wear and tear to the golf ball hitting area is not only unsightly but the abrading of the artificial turf degrades the simulation of hitting on natural turf. The artificial turf rapidly degrades with repeated clubs miss hits occurring as the golf club head has a descending motion downwardly on to the turf at a site rearward of the location of the golf ball on the supporting golf ball tee. U.S. Pat. No. 6,156,396 discloses a golf practice mat with a thick foam rubber base supporting artificial grass carpet so that when a golf ball on the carpet surface is struck, the carpet can slide a limited distance to absorb the force of the club. The desire is to lessen the reaction force on the golfer's hands and arms. The elastic biasing force on the practice mat returns the carpet to its original position after the completion of the practice swing. U.S. Pat. No. 6,106,409 discloses a golf practice mat having three sections in a spaced relation. Each section is provided with a removable mat and the simulated grass in each section corresponds to different grassy conditions likely to be encountered on a golf course. U.S. Pat. No. 3,348,847 discloses a golf practice device incorporating a discrete divot portion, which permits dislodgement and flight away of the divot portion from the practice device to simulate the striking of a golf ball in the fairway of a golf course. Such known golf practice devices are not only expensive to procure and maintain, but also provide only single purpose practice aspects to the game of golf. These devices are also subject to extreme wear and tear necessitating frequent costly replacement.

A need therefore exists for a more versatile golf mat having a player surface, which can be indexed, into positions for renewing a worn practice area each containing a golf ball tee.

Accordingly, it is an object of the present invention to provide a golf mat with a support area for a golfer and a continuous outer peripheral margin to the player surface containing spaced apart golf hitting areas each provided with a golf ball tee and moveable so that the hitting areas can be moved into a predetermined golf ball hitting location.

It is a further object of the present invention to provide a golf mat with a playing surface on a resilient carrier pad supported by a platform form for rotary indexing of spaced apart golf ball hitting locations each containing a golf ball tee into a position for impact between a golf club with a golf ball on the tee.

SUMMARY OF THE INVENTION

According to the present invention there is provide a golf practice mat including the combination of a platform; a mat including a playing surface on a resilient carrier pad having a load bearing face surface for support by the platform, the mat having an outer peripheral margin containing spaced apart areas of the playing surface each containing a golf tee mounting aperture, a mat retainer carried by the platform to index the mat into a position to locate each selected one of the spaced apart areas of the playing surface and the associated selected golf tee mounting aperture thereof at a predetermined golf ball hitting location above the platform, and a golf ball tee including a flexible golf tee shank permeating the associated selected golf tee mounting aperture for retention by the mat to support a golf ball atop the golf ball tee within the selected one of the spaced apart areas of the playing surface at the predetermined golf ball hitting location for impact with a golf club.

In the preferred form the present invention further provides a driving range mat apparatus including a platform, a golf mat having a playing surface to support a golfer for address of a golf ball at a contiguous outer peripheral margin of the playing surface, the golf mat having a resilient carrier pad adhered to the playing surface for support by the platform, the contiguous outer peripheral margin of the playing surface having spaced apart golf ball hitting areas each including a golf club approach path and a golf club follow through path intercepted by a golf tee mounting aperture, a mat retainer carried by the platform to index the mat into a position to locate any selected one of the spaced apart golf ball hitting areas and the associated golf tee mounting aperture thereof at a predetermined golf ball hitting location above the platform, and a golf ball tee including a flexible golf tee shank permeating the associated selected golf tee mounting aperture for retention by the mat to support a golf ball atop the golf ball tee within the selected one of the spaced apart golf ball hitting areas at the predetermined golf ball hitting location for impact with a golf club.

BRIEF DESCRIPTION OF THE SEVERAL VIEWS OF THE DRAWINGS

The present invention will be more fully understood when the following description is read in light of the accompanying drawings in which.

DETAILED DESCRIPTION OF THE INVENTION

Figure 1:
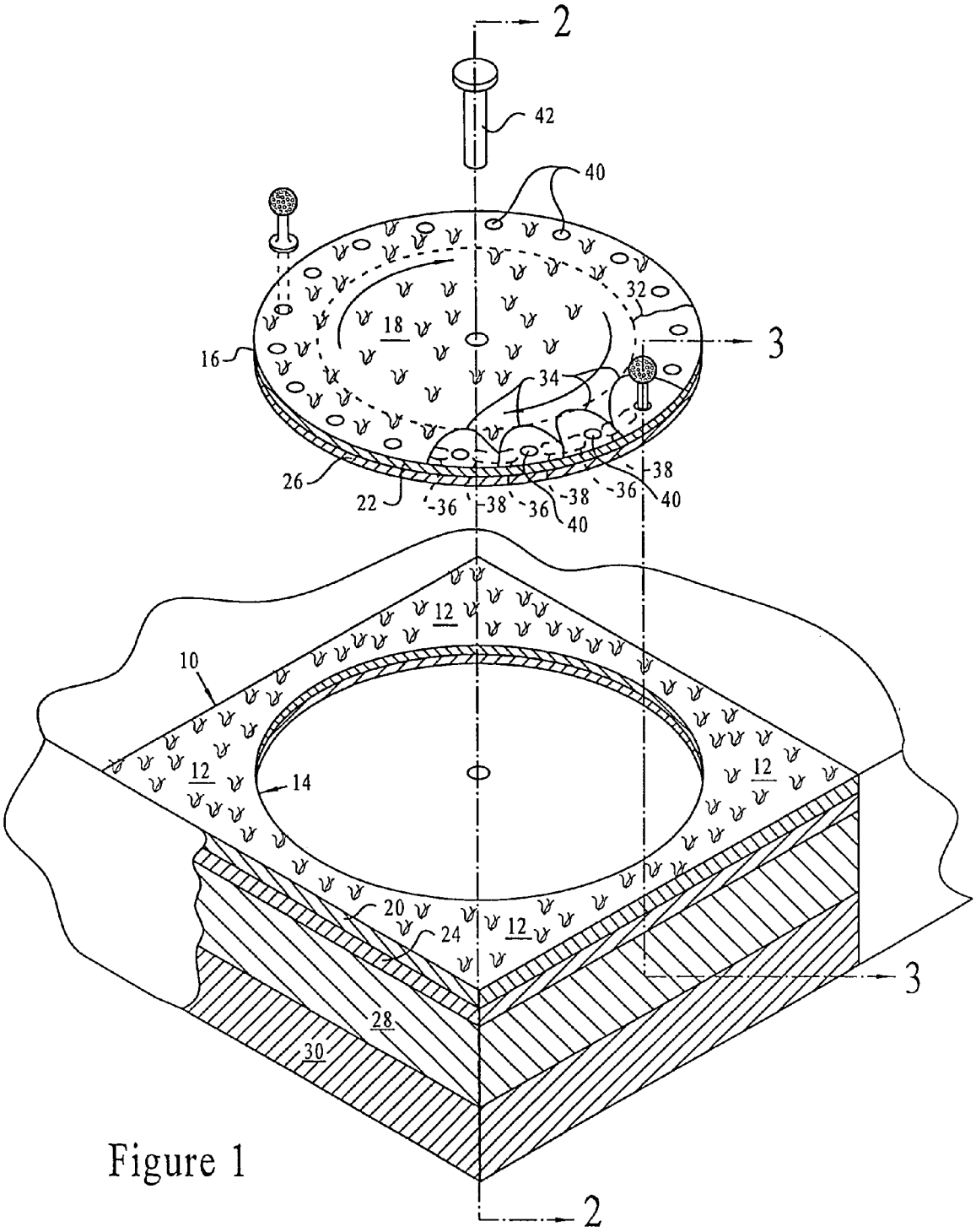
FIG. 1 is an isometric view illustrating a golf practice mat incorporating the features of the present invention according to the first embodiment.

Shown in FIG. 1 is a playing field 10 preferably including spandrels 12 with arcuate edge segments 14 conforming to and disbursed in quadrants, in a confronting relationship, about the outer peripheral annular edge 16 of a disk shaped golf mat 18. The spandrels 12 are used as stationary extensions to the disk shaped golf mat 18.

Figure 2:
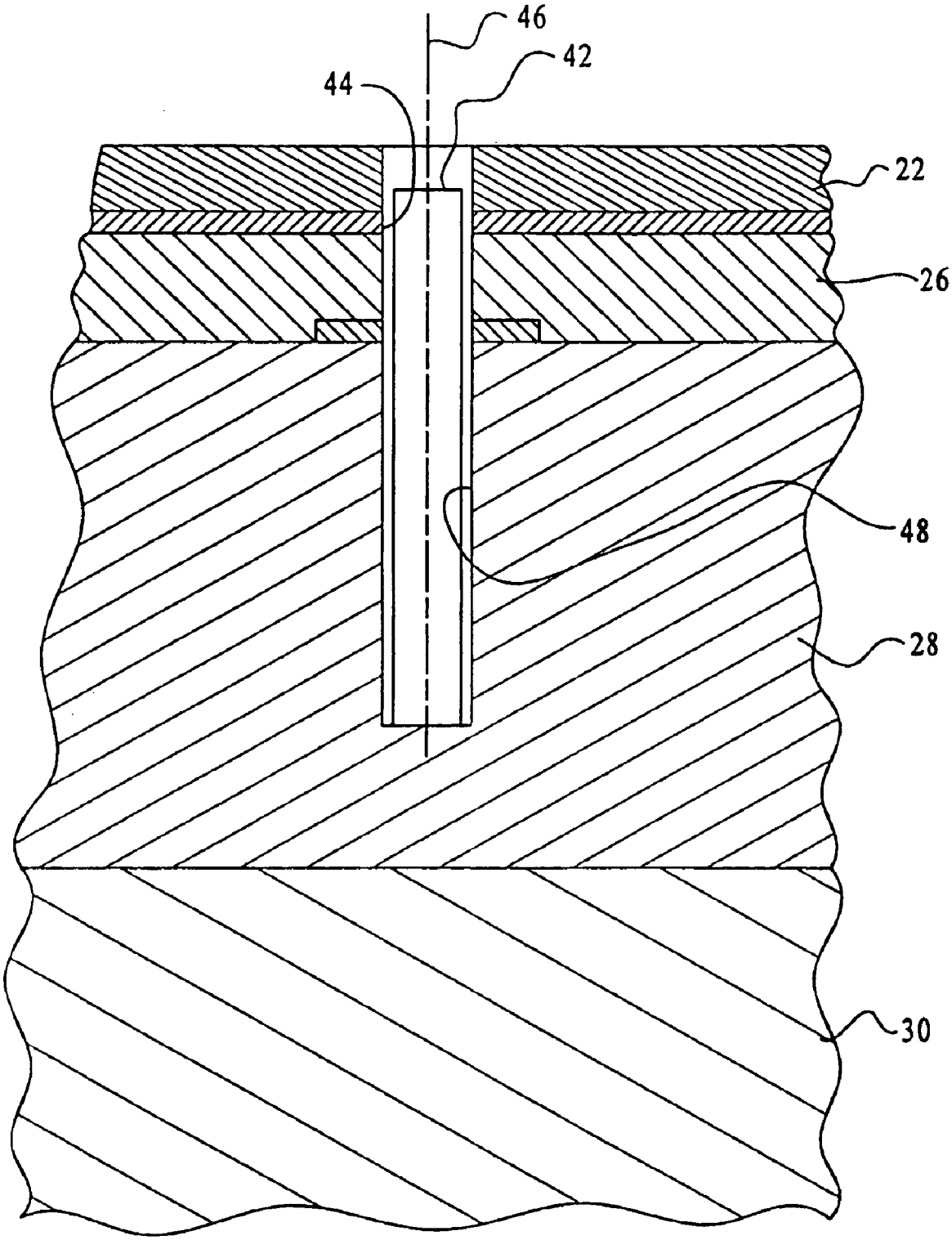
FIG. 2 is a sectional view taken along lines 2—2 of FIG. 1.

The spandrels 12 and the dish shaped golf mat 18 are made up a playing surface formed of layers of artificial turf 20 and 22, respectively, located on and preferably secured by adhesive to a correspondingly shaped rubber sponge mat layers 24 and 26. Each of the rubber sponge mat layers 24 and 26 have a load bearing face surface supported on a horizontal face surface of platform 28 comprising asphalt or cement. The platform 28 is supported by earth 30. The layer of artificial turf 20 of the disc shaped golf mat 18 forms a playing surface of a sufficient size to provide an area for footing of a golfer when assumes a conventional golf stance spaced from an outer peripheral margin 32 of the golf mat 18. The outer peripheral margin 32 of the playing surface is sufficiently sized to form spaced apart golf ball hitting areas 34 each including a golf club approach path 36 and a golf club follow through path 38 intercepted by a golf tee mounting aperture 40. A mat retainer constrains the golf mat 18 for rotational movement on the platform 28, the mat retainer comprises either or both of the edge segments 14 of the spandrels and axle 42. The sponge mat layer 26 of the spandrels 12 engages and retains the mat on the platform 28. The axle 42 extends in an opening 44 located in the geometrical center of the disc shaped golf mat 18. The axle 42 has a central longitudinal axis 46 supported in an elongated hole 48 in the platform to extend vertically through the central opening 44 in the playing surface constrains the mat for rotary indexing of mat on the platform. As best shown in FIG. 2, the axle 42 takes the form of an elongated shaft with sufficient length so that about ⅔ of the length of the axle traverses the elongated hole 48 with the remaining ⅓ of the axle length extending in the opening 44 of the golf mat 18.

The guidance provide by the seating of the axle in the central opening 44 provides guided rotary movement of the golf mat 18 preferably by the use of a reinforcing guide washer 50 secured by adhesive within a recess formed in the load bearing surface of the sponge mat layer 26. As shown in FIG. 2 the upper terminal end of axle 42 is recessed below the layer of artificial turf forming the playing surface 22. The axle 42 can be readily removed from the mat and, if desired the opening 44 to allow replacement of the dish shaped golf mat 18 as will be necessary from time to time. However, it is an important feature of the present invention to minimize the need to replace the golf mat by the provisions of the golf mat with a sufficiently large playing surface to not only support a golfer for address of a golf ball but also a contiguous outer peripheral margin of the playing surface. The spaced apart golf ball hitting areas 34 each include the golf club approach path 36 and a golf club follow through path 38 intercepted by the golf tee mounting aperture 40.

Figure 3:
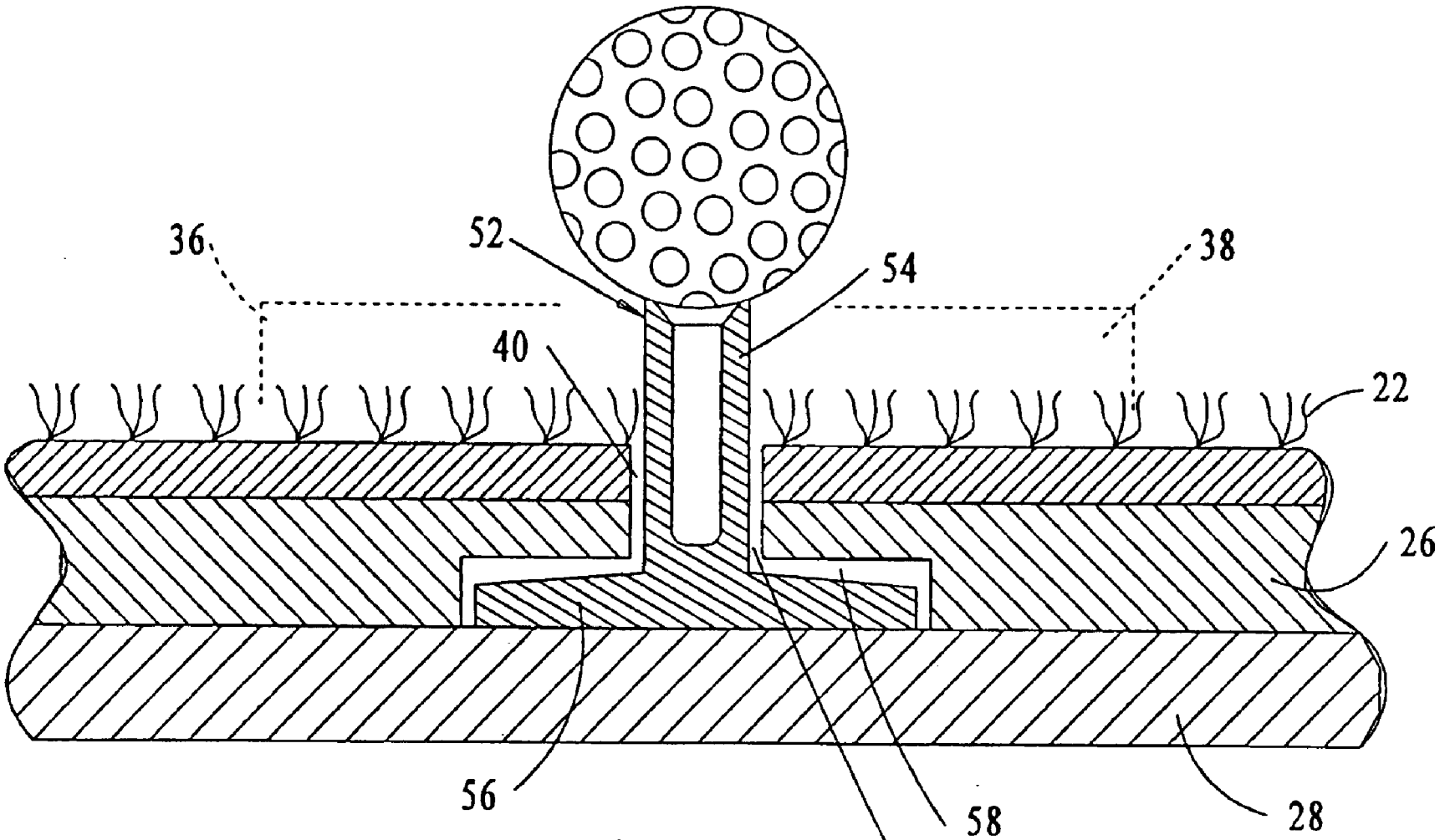
FIG. 3 is a sectional view taken along lines 3—3 of FIG. 1.

The mat retainer comprised of the axle 42 and/or the spandrels 12 are used to allow indexing of the golfing mat into a position to locate any selected one of the spaced apart golf ball hitting areas 34 and the associated golf tee-mounting aperture 40 thereof at a predetermined golf ball hitting location about the platform. As shown in FIG. 3, a conventional form of a golf ball supporting tee is identified by reference numeral 52 which includes a flexible tee shank 54 having a tubular cross sectional configuration extending upwardly from disc shaped base section 56. The base section 56 is secured by a layer of adhesive in a recess 58 formed in the load bearing surface of the rubber sponge matt layer 26. The recess 50 is aligned with an aperture 40 to allow the tee shank 54 to extend above the playing field for positioning a golf ball at a desired elevation for contact with a golf club head.

Figure 4:
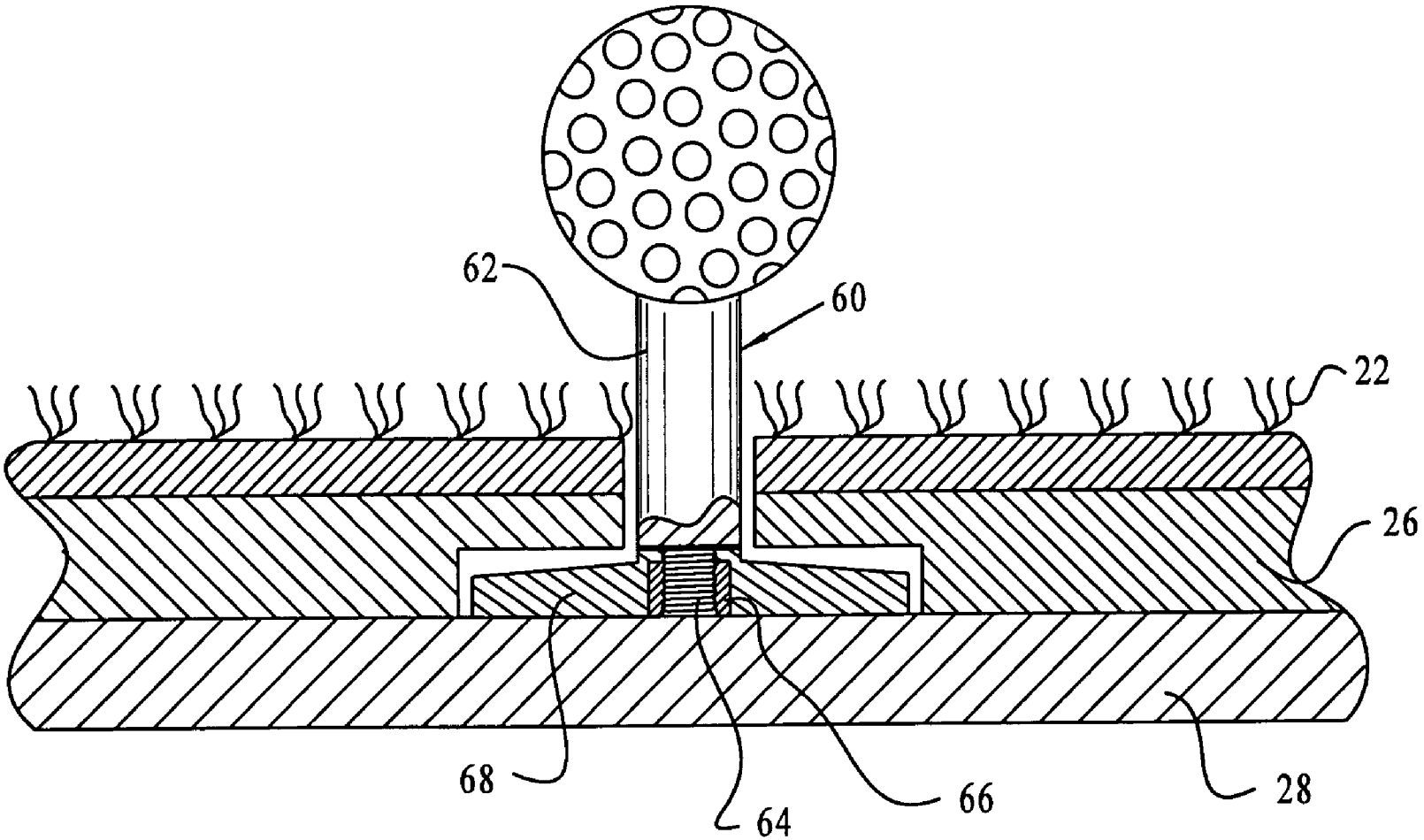
FIG. 4 is a sectional view, similar to FIG. 2 illustrating a modified form of golf ball support tee useful in a golf mat of the present invention.

The modified golf ball tee 60 according to the embodiment shown in FIG. 4 is constructed to allow replacement of a golf tee shank 62 with any of a variety of golf tee shank having different shank lengths and releasable secured by an inner connection formed by a threaded shaft 64 engaged by a nut member 66 supported by the base plate 68. It is also within the scope of the present invention to utilize a golf ball tee having a readily adjustable height for selecting the elevation at which a golf ball is supported above the playing field. One such form of adjustable golf ball tee is disclosed in my U.S. Pat. No. 5,776,014, which disclosure is incorporated herein by this identification.

Figure 5:
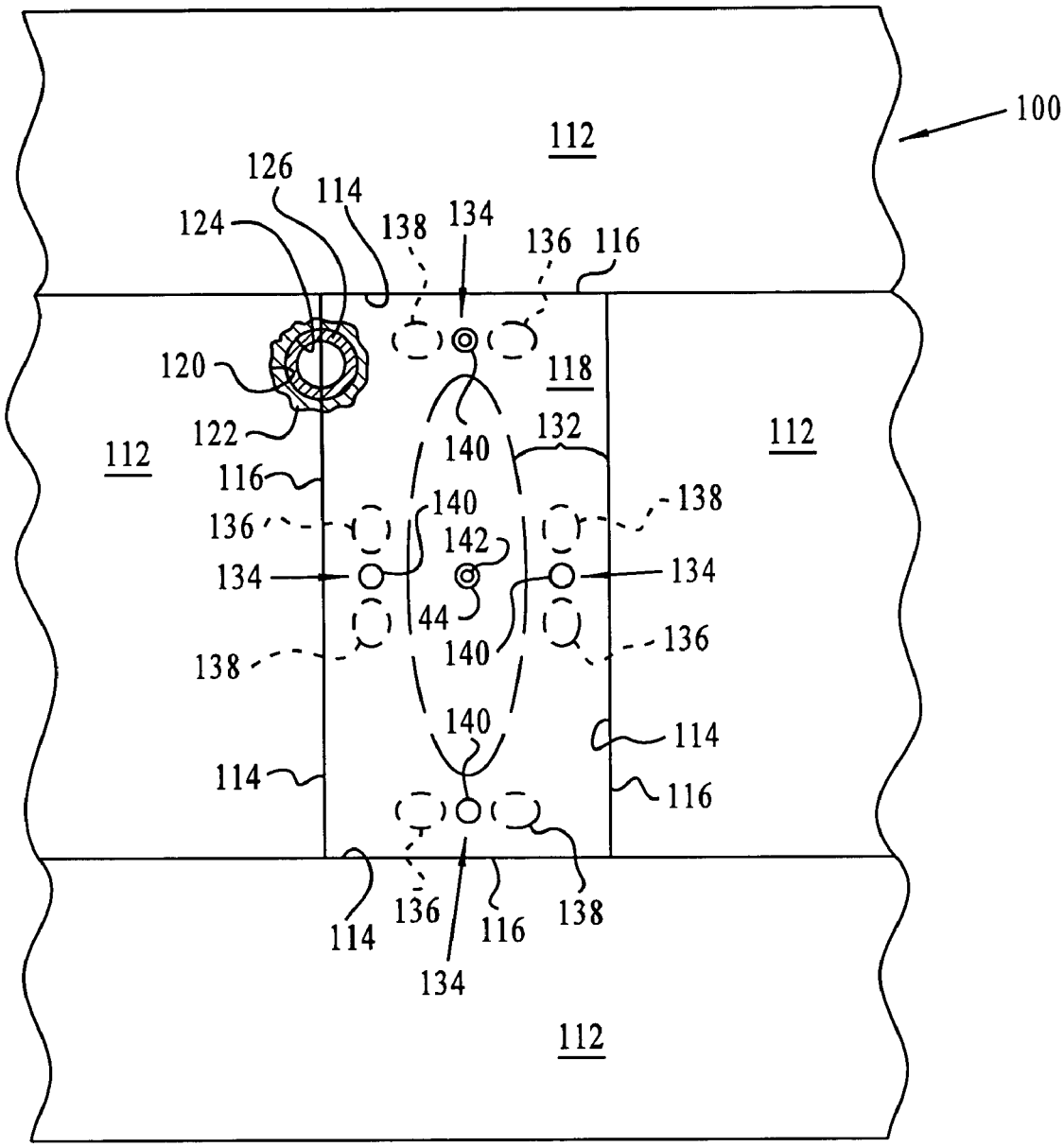
FIG. 5 is a plane view of a golf practice mat according to a second embodiment of the present invention.

FIG. 5 illustrates a second embodiment of the present invention which differs from the embodiment shown in FIGS. 1–3 and described herein above by configuration of the component parts making up the playing field 10. As shown in FIG. 5, a playing field 100 including filler pieces 112 with linear edge segments 114 conforming to and disbursed in quadrants, in a confronting relationship, about the outer peripheral edges 116 of a rectangular shaped golf mat 118. The term rectangularly shaped is used herein as the generic expression thus including a golf mat with equal lengths sides, i. e. a square shaped mat as well as linear opposed sides of equal length and of a different length than the ends. The filler pieces 112 are used as stationary extensions to the rectangular shaped golf mat 118.

The filler pieces 112 and the rectangular shaped golf mat 118 have a playing surface formed of layers of artificial turf 120 and 122, respectively, located on correspondingly shaped rubber sponge mat layers 124 and 126 as described in shown herein before and include the rubber sponge mat layers supported on a horizontal face surface of platform 128. The layer of artificial turf 120 or 122 form a playing surface of a sufficient size to provide an area for footing of a golfer when assumes a conventional golf stance spaced from an outer peripheral margin 132 of the playing field 100. The outer peripheral margin 132 is sufficiently sized to form spaced apart golf ball hitting areas 134 each including a golf club approach path 136 and a golf club follow through path 138 intercepted by a golf tee mounting aperture 140. A mat retainer constrains the rectangular golf mat 118 for rotational movement on the platform 128, the mat retainer comprises either or both of the edge segments of the filler pieces 112 and an axle 142. The sponge mat layer 126 of the filler pieces 112 engages and retains the golf mat on the platform. The axle 142 extends in the opening 44, as shown in the first embodiment of FIG. 2 but centered in the rectangular shaped golf mat 118. As in the first embodiment, the axle 42 takes the form of an elongated shaft with sufficient length so that about ⅔ of the length of the axle traverses the elongated hole in the platform with the remaining ⅓ of the axle length extending in the opening 144 of the golf mat 118.

The guidance provide by the seating of the axle in the central opening 144 provides guided rotary movement of the golf mat 18 preferably by the use of the reinforcing guide washer 50 secured by adhesive within a recess formed in the load bearing surface of the sponge mat layer 26. As shown in FIG. 2 the upper terminal end of axle 42 is recessed below the layer of artificial turf forming the playing surface 22. The axle 42 can be readily removed from the mat and, if desired the opening 144 to allow replacement of the rectangular shaped golf mat 118 as will be necessary from time to time.

The mat retainer comprised of the axle 142 and/or the filler pieces 112 are used to allow indexing of the golfing mat into a position to locate any selected one of the spaced apart golf ball hitting areas 134 and the associated golf tee-mounting aperture 140 thereof at a predetermined golf ball hitting location about the platform. In the same manner as shown in FIG. 3, the conventional form of a golf ball supporting tee 52 extends upwardly from the disc shaped base section 56. The base section 56 is secured by a layer of adhesive in a recess 58 formed in the load bearing surface of the rubber sponge matt layer 26. The recess 50 is aligned with an aperture 40 to allow the tee shank 54 to extend above the playing field for positioning a golf ball at a desired elevation for contact with a golf club head.

While the present invention has been described in connection with the preferred embodiments of the various figures, it is to be understood that other similar embodiments may be used or modifications and additions may be made to the described embodiment for performing the same function of the present invention without deviating there from. Therefore, the present invention should not be limited to any single embodiment, but rather construed in breadth and scope in accordance with the recitation of the appended claims.

The invention claimed is:

1. A golf practice mat including the combination of:

a platform;

a golf mat including a playing surface bounded by an outer peripheral edge on a resilient carrier pad having a load bearing face surface for support by said platform, said mat having a sufficiently large playing surface to both support a golfer for address of a golf ball and provide a contiguous outer peripheral margin containing spaced apart areas of said playing surface each containing a golf tee mounting aperture;

a golf mat retainer carried by said platform to index said golf mat into a position to both support a golfer for address of a golf ball and locate each selected one of the spaced apart areas of said playing surface and the associated golf tee mounting aperture thereof at a predetermined golf ball hitting location above said platform, said golf mat retainer comprising edge segments conforming to and disbursed in a confronting relation about said outer peripheral edge of said golf mat for forming stationary extensions to said playing surface; and a golf ball tee including a flexible golf tee shank permeating said associated selected golf tee mounting aperture for retention by said golf mat to support a golf ball atop said golf ball tee within said selected one of the spaced apart areas of said playing surface at the predetermined golf ball hitting location for impact with a golf club.

2. The golf practice mat according to claim 1 wherein said golf ball tee further includes a base plate secured to an end of said flexible golf tee for support within a recess formed in said load bearing face surface of said golf mat.

3. The golf practice mat according to claim 2 wherein said golf ball tee further includes a threaded nut member supported by said base plate and a threaded shaft protruding from said flexible golf tee shank for releasably joining said golf tee shank to said base plate.

4. The golf practice mat according to claim 1 wherein said golf ball tee comprises: an adjustable tee extendable through said golf tee mounting aperture in said mat to present a golf ball support surface on said flexible golf tee shank at a distance sufficient to extend beyond said golf mat to support a golf ball within a selectable range of elevations above the playing surface of said golf mat;

a collar supported within a recess in said golf mat; and threaded fasteners for releasably interconnecting said collar and said golf ball tee.

5. The golf practice mat according to claim 1 wherein said playing surface includes a stratum of artificial turf.

6. The golf practice mat according to claim 1 wherein said golf mat is bounded by an annular outer peripheral edge and said golf mat retainer includes arcuate edge segments conforming to and disbursed about the annular outer peripheral edge of said golf mat for forming a stationary extensions to said playing surface.

7. The golf practice mat according to claim 1 wherein said golf mat is bounded by a rectangular outer peripheral edge and said golf mat retainer includes edge segments conforming to and disbursed about said rectangular outer peripheral edge of said golf mat for forming a stationary extensions to said playing surface.

8. A driving range mat apparatus including:

a platform;

a golf mat having a having a sufficiently large playing surface bounded by an outer peripheral edge to support both a golfer for address of a golf ball and provide a contiguous outer peripheral margin of said playing surface, said golf mat having a resilient carrier pad adhered to said playing surface for support by said platform, said contiguous outer peripheral margin of said playing surface having spaced apart golf ball hitting areas each including a golf club approach path and a golf club follow through path intercepted by a golf tee mounting aperture and each of said spaced apart golf heating areas being addressed at a fixed indexed position by a golfer when supported by said playing surface;

a golf mat retainer carried by said platform to index said golf mat into a position to both support a golfer for address of a golf ball and locate any selected one of the spaced apart golf ball hitting areas and the associated golf tee mounting aperture thereof at a predetermined golf ball hitting location above said platform, said mat retainer comprising edge segments conforming to and disbursed about said outer peripheral edge of said golf mat for forming stationary extensions to said playing surface; and a golf ball tee including a flexible golf tee shank permeating said associated selected golf tee mounting aperture for retention by said golf mat to support a golf ball atop said golf ball tee within said selected one of the spaced apart golf ball hitting areas at said predetermined golf ball hitting location for impact with a golf club.

9. The golf practice mat according to claim 8 wherein said golf mat is bounded by an annular outer peripheral edge and said golf mat retainer includes arcuate edge segments conforming to and disbursed about the annular outer peripheral edge of said golf mat for forming a stationary extensions to said playing surface.

10. The golf practice mat according to claim 8 wherein said golf mat is bounded by a rectangular outer peripheral edge and said golf mat retainer includes edge segments conforming to and disbursed about said rectangular outer peripheral edge of said golf mat for forming a stationary extensions to said playing surface.

* * * * *